US006413636B1

(12) United States Patent
Andrews et al.

(10) Patent No.: US 6,413,636 B1
(45) Date of Patent: Jul. 2, 2002

(54) PROTECTIVE YARN

(76) Inventors: Mark A. Andrews, 865 Kings Crossing Dr., Concord, NC (US) 28027; Gregory V. Andrews, 342 Beckwick La., Concord, NC (US) 28025

( * ) Notice: Subject to any disclaimer, the term of this patent is extended or adjusted under 35 U.S.C. 154(b) by 0 days.

(21) Appl. No.: 09/453,273

(22) Filed: Dec. 2, 1999

Related U.S. Application Data

(63) Continuation of application No. 08/883,143, filed on Jun. 27, 1997, now abandoned.
(60) Provisional application No. 60/020,640, filed on Jun. 27, 1996, now abandoned.

(51) Int. Cl.[7] ..... D02G 3/00
(52) U.S. Cl. ..... 428/377; 428/375; 428/401; 428/902; 428/911
(58) Field of Search ..... 428/375, 377, 428/245, 380, 230, 401, 902, 911

(56) References Cited

U.S. PATENT DOCUMENTS

| | | | | |
|---|---|---|---|---|
| 2,335,644 A | * | 11/1943 | Camp | 57/140 |
| 3,889,035 A | | 6/1975 | Jakes | |
| 4,202,382 A | * | 5/1980 | Westhead | 139/383 A |
| 4,384,449 A | | 5/1983 | Byrnes, Sr. et al. | |
| 4,470,251 A | | 9/1984 | Bettcher | |
| 4,777,789 A | | 10/1988 | Kolmes et al. | |
| 4,818,587 A | | 4/1989 | Ejima et al. | |
| 4,838,017 A | | 6/1989 | Kolmes et al. | |
| 4,886,691 A | | 12/1989 | Wincklhofer | |
| 4,912,781 A | | 4/1990 | Robins et al. | |
| 4,936,085 A | | 6/1990 | Kolmes et al. | |
| 5,010,723 A | | 4/1991 | Wilen | |
| 5,070,540 A | | 12/1991 | Bettcher et al. | |
| 5,119,512 A | | 6/1992 | Dunbar et al. | |
| 5,177,948 A | | 1/1993 | Kolmes et al. | |
| 5,287,690 A | | 2/1994 | Toon | |
| 5,423,168 A | | 6/1995 | Kolmes et al. | |
| 5,442,815 A | | 8/1995 | Cordova et al. | |
| 5,628,172 A | | 5/1997 | Kolmes et al. | |
| 5,632,137 A | * | 5/1997 | Kolmes et al. | 57/212 |
| 5,655,358 A | * | 8/1997 | Kolmes et al. | 57/212 |
| 5,845,476 A | | 12/1998 | Kolmes | |

FOREIGN PATENT DOCUMENTS

| | | |
|---|---|---|
| EP | 0 498 216 A1 | 8/1992 |

* cited by examiner

*Primary Examiner*—Merrick Dixon
(74) *Attorney, Agent, or Firm*—Adams, Schwartz & Evans, P.A.

(57) ABSTRACT

A protective yarn having a single fiberglass core fiber and one or more cover members is disclosed. At least one of the cover members are fibers selected from the group consisting of aramid fiber, ultrahigh molecular weight polyolefin fiber, polyester, nylon and polyacrylic fibers. To prevent glass fragment breakout, the cover members are wrapped, wound or twisted around the core in a manner which permits successive layers to be wrapped, wound or twisted around the core in an opposite direction from the cover member immediately below. In a preferred embodiment, one of the cover members is a substantially non-slippery fiber. The non-slippery fiber is selected from the group consisting of polyester, nylon and cotton. The construction and composition of the invented protective yarn provides a low cost component for making protective gloves and other protective garments capable of providing a user substantial cut protection while affording the user significant freedom of movement. The invented protective yarn also resists shrinkage during the cleaning process which is typical of existing protective gloves and garments.

71 Claims, 2 Drawing Sheets

PROTECTIVE YARN

CROSS REFERENCE TO RELATED APPLICATION

This application is a continuation of U.S. application Ser. No. 08/883,143, filed Jun. 27, 1997, now abandoned.

This application claims the benefit of U.S. Provisional Application No. 60/020,640, filed Jun. 27, 1996, abandoned.

FIELD OF THE INVENTION

The present invention relates to protective yarns. More particularly, the present invention relates to a protective yarn having a fiberglass fiber core and one or more cover members of fibers that are of dissimilar materials from the core fibers.

BACKGROUND OF THE INVENTION

Protective clothing has existed for hundreds of years. Among the first type of protective clothing was armor worn by knights. Of course, these heavy and inflexible metal sheets limited a knight's movement and visibility. While providing excellent protection against blade injuries, plate armor limited the manual dexterity of the wearer. Later, armorers developed chain mail, and while permitting some manual dexterity on the part of the wearer, their mail was heavy and quickly fatigued the wearer.

Until recently, meat cutting plants employed chain mail type gloves to prevent accidental cuts to a meat cutters' hands. Like their medieval counterparts, the choir mail worn by meat cutters quickly fatigued the user's hands.

More recently, users needing protection against cuts and also requiring a high level of dexterity have turned to gloves knitted from engineered yarns. While dramatically increasing the flexibility and manual dexterity, gloves engineered using aramid fibers such as "Kevlar®" and gloves engineered using ultrahigh molecular weight polyolefin fiber such as ultrahigh molecular weight polyethylene or polypropylene extended chain polyethylenes are extremely costly. Commercial examples of gloves using these engineered yarns include Spectra® 900 and Spectra® 1000, sold by AlliedSignal, Inc and Kevlar®, sold by the Du Pont Company of Wilmington, Del. Garments knitted with yarns such as Spectrao have problems with yarn shrinkage.

A need, therefore, exists for an engineered protective yarn which provides cut protection and freedom of movement at a lower cost. A need also exists for an engineered protective yarn which resists the effects of high temperatures such as shrinkage.

Numerous attempts have been made to employ fiberglass fiber in protective yarns which are then knitted into protective gloves. However, a new problem has been created by adding fiberglass fiber to yarn. Fiberglass fiber is brittle and small glass fragments are likely to separate from the glass fibers and irritate the skin of the user. Naturally, glove irritation reduces the likelihood that a user will wear their protective garments. Attempts have been made to coat fiberglass fiber in order to prevent skin irritating fragments from detaching from the main fiber strand. However, these coating attempts have proven to be less than completely successful.

DESCRIPTION OF THE PRIOR ART

Applicants are aware of the following relevant U.S. Patents.

| U.S. Pat. No. | ISSUE DATE | INVENTOR | TITLE |
|---|---|---|---|
| 4,383,449 | 05-23-1983 | Byrne, Sr. et al. | PROTECTIVE GLOVES AND THE LIKE AND A YARN WITH FLEXIBLE CORE WRAPPED WITH ARAMID FIBER |
| 4,651,514 | 03-24-1987 | Collett | ELECTRICALLY NONCONDUCTIVE, ABRASION AND CUT RESISTANT YARN |
| 4,777,789 | 10-18-1988 | Kolmes et al. | WIRE WRAPPED YARN FOR PROTECTIVE GARMENTS |
| 4,818,587 | 04-04-1989 | Ejima et al. | NONWOVEN FABRICS AND METHOD FOR PRODUCING THEM |
| 4,838,017 | 06-13-1989 | Kolmes et al. | WIRE WRAPPED YARN FOR PROTECTIVE GARMENTS |
| 4,886,691 | 12-12-1989 | Wincklhofer | CUT RESISTANT JACKET FOR ROPES, WEBBING, STRAPS, INFLATABLES AND THE LIKE |
| 4,936,085 | 06-26-1990 | Kolmes et al. | YARN AND GLOVE |
| 5,010,723 | 04-30-1991 | Wilen | TWISTED YARN WHICH WILL MAINTAIN ITS TWIST AND PRODUCTS PRODUCED THEREFROM |
| 5,119,512 | 06-09-1992 | Dunbar et al. | CUT RESISTANT YARN, FABRIC AND GLOVES |
| 5,177,948 | 01-12-1993 | Kolmes et. al. | YARN AND GLOVE |

U.S. Pat. No. 4,384,449 shows protective gloves and the like and a yarn comprising a core of a flexible wire alongside an aramid fiber strand or strands and a covering of aramid fiber such as that manufactured and sold under the trademark 'Kevlar' by the DuPont Company of Wilmington, Del. in which the aramid fiber is either spun or filament. Two aramid fiber strands, either spun or filament, are wrapped around the core with one strand wrapped in a clockwise direction and the other strand wrapped in a counter-clockwise direction with the opposite spiral wrapping of the strands serving to secure the strands in position on the core without any other securing means. The yarn having a flexible core with aramid fiber strands wrapped thereon is used to make protective gloves on conventional glove knitting or weaving machinery and is capable of movement in relation to needle eyes and the like without jamming in the same manner as various natural and synthetic fiber yarns. The yarn having a flexible core with aramid fiber strands wrapped thereon is also used in making various other products normally made of conventional fiber yarn.

U.S. Pat. No. 4,651,514 shows an electrically non-conductive, cut and abrasion resistant yarn for use in the manufacture of protective coverings including a core of monofilament nylon having a diameter in the range of about 0.004 to 0.020 inches, a first wrap on the core of at least one strand of aramid fiber having a cotton count size in the range of about 1/1 to 30/1 and a second wrap on the core of texturized nylon of two to eight ply construction. Each ply is made up of 24 to 44 nylon filaments with each filament being about 50–90 denier.

U.S. Pat. No. 4,777,789 shows an improved yarn, fabric and protective garment made from such yarn where the yarn, fabric and garment exhibit increased cut resistance. The yarn includes a core made of fiber and a covering wrapped around the core, the covering includes at least one strand of wire wrapped around the core.

U.S. Pat. No. 4,818,587 shows nonwoven fabrics contain at least 30% by weight of heat-adhesive composite fibers consisting of core portion and sheath portion, said core portion being of the side-by-side type composite structure comprising two core components of different polypropylene base polymers in a composite ratio of 1:2 to 2:1, one of said core components having a Q value, expressed in terms of the weight-average molecular weight/the number-average molecular weight, equal to or higher than 6 and the other having a Q value equal to or lower than 5, and said sheath portion meeting at least the requirement that it should comprise a sheath component of a polyethylene base polymer having a melting point lower by at least 20° C. than the lower one of the melting points of said two core components. The nonwoven fabrics are bulky and soft due to the crimps of the heat-adhesive composite fibers esultant form the core portion and are stabilized by the inter-fiber bonds of the sheath portion.

U.S. Pat. No. 4,838,017 shows an improved yarn, fabric and protective garment made from such yarn where the yarn, fabric and garment exhibit increased cut resistance. The yarn includes a core made of fiber and a covering wrapped around the core, the covering includes at least one strand of wire wrapped around the core.

U.S. Pat. No. 4,886,691 shows a cut resistant article comprising a cut resistant jacket surrounding a less cut resistant member. The jacket comprises a fabric of yarn and the yarn consists essentially of a high strength, longitudinal strand having a tensile strength of at least 1 GPa. The strand is wrapped with another fiber or the same fiber.

U.S. Pat. No. 4,936,085 shows an improved yarn, fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands is fiberglass, the non-fiberglass strands are preferably nylon or polyester.

U.S. Pat. No. 5,010,723 shows a yarn produced from two or more twisted cellulosic fibers, such as cotton or cotton rayon fibers, the plies being helically wound around a thermoplastic filament core which is subsequently melted to bind the inner portions of the yarn together so that it does not untwist or shed lint readily. The yarn is employed in a dust mop or floor mat for a shampoo bonnet for stain resistant treated carpet.

U.S. Pat. No. 5,119,512 shows a cut resistant article comprising a cut resistant jacket surrounding a less cut resistant member. The jacket comprises a fabric of yarn and the yarn consists essentially of a high strength, longitudinal strand having a tensile strength of at least 1 GPa. The strand is wrapped with another fiber or the same fiber. In another embodiment, the invention is a highly cut resistant yarn of at least two nonmetallic fibers. One fiber is inherently cut resistant like high strength polyethylene, polypropylene or aramids. The other fiber in the yarn has a high level of hardness.

U.S. Pat. No. 5,177,948 shows an improved non-metallic yarn, fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands of the core is fiberglass, the non-fiberglass strands are preferably nylon, extended chain polyethylene, aramid or polyester.

SUMMARY OF THE INVENTION

In a preferred embodiment of the present invention, a protective yarn has a single fiberglass core fiber and one or more cover members. The cover members are selected from the group consisting of aramid fiber, ultrahigh molecular weight polyolefin fiber, polyester, nylon and polyacrylic fibers. The cover members are wrapped, wound or twisted around the core in a manner which permits successive layers to be wrapped, wound or twisted around the core in an direction opposite that of the cover member immediately below.

By using only one fiberglass core instead of multiple non-glass fiber cores, the present invention provides cut resistance cut resistant fibers such as Spectral and Kevlarm at a significantly lower cost. Substituting a lower strength hard and brittle fiber material such as fiberglass to the core of the yarn adds a significant level of cut resistance at a fraction of the cost. The addition of new yarn components has substantially reduced a user's manual dexterity problems and increased the protection offered for cuts.

The present invention overcomes the limitations of existing protective yarns by using a single longitudinal core fiber that is a hard and brittle material. Typically, the core material is a strand of fiberglass. In order to minimize the amount of fiberglass fragments that break free from the fiberglass strand and irritate the skin of the person coming in contact with the fiberglass fragments, a series of covering wraps are employed. These covering wraps may also be a highly cut resistant material in and of themselves. In addition, the outer cover wrap may be a fiber that is smooth to the touch such as polyester or nylon. However, in order to maximize cut resistance, the covering wraps may be selected from the group consisting of polyolefins such as Spectram or aramids such as Kevlar®.

Preferably, the cover members are wrapped, wound or twisted around the core in a manner which permits successive layers to be wrapped, wound or twisted around the core in an opposite direction from the cover element immediately below.

The resulting protective yarns are then suitable for knitting into protective gloves and other protective garments. These yarns offer an inexpensive alternative to existing protective yarns while providing substantial cut protection without irritating a user's skin.

OBJECTS OF THE INVENTION

An object of the present invention is to provide a protective yarn.

Another objective of the present invention is to provide a yarn with a sufficiently low composite denier such that the composite yarn is knittable into a protective glove or other protective apparel.

Another objection of the present invention is to provide a protective yarn that can be knitted into a glove which does not irritate the wearer's skin, thereby increasing the likelihood that a person will continuously wear the gloves.

Another object of the invention is to provide a protective yarn that can be knitted into a glove which is flexible and which does not unacceptably diminish the manual dexterity of the wearer.

Another objective of the present invention is to provide a protective yarn that can maintain its size when it is exposed to the extremely high temperatures employed in washing protective garments and gloves in order to kill bacteria.

Another objective of the present invention is to minimize the undesirable shrinkage of composite yarns having SpectraO fiber or other similar fiber when the composite yarn is subjected to the cleaning process.

Another objective of the present invention is to provide a yarn having fewer defects for efficient knitting of protective garments and gloves with superior characteristics.

SUMMARY OF THE ACHIEVEMENT OF THE OBJECTS OF THE INVENTION

From the foregoing, it is readily apparent that we have invented an improved protective yarn. The improved protective yarn is a single longitudinal fiberglass fiber core wraped with cover layers composed of fibers selected from the group consisting of polyolefins such as Spectra® or aramids such as Kevlar®. Winding the cover layers on the fiberglass core so that an adjacent cover layer is wound in a direction opposite to the layer immediately beneath it gives the protective yarn the desired characteristics at a much lower cost than existing yarns. The invented protective yarn is flexible enough that it can be knitted into a protective fabric or garment on conventional knitting or weaving machines and yet is strong enough to offer substantial cut resistance. Finally, the invented protective yarn resists shrinkage which results from exposure to extremely high temperatures during the washing process.

BRIEF DESCRIPTION OF THE DRAWINGS

The foregoing and other objects will become more readily apparent by referring to the following detailed description and the appended drawing in which.

DETAILED DESCRIPTION

Figure 1:
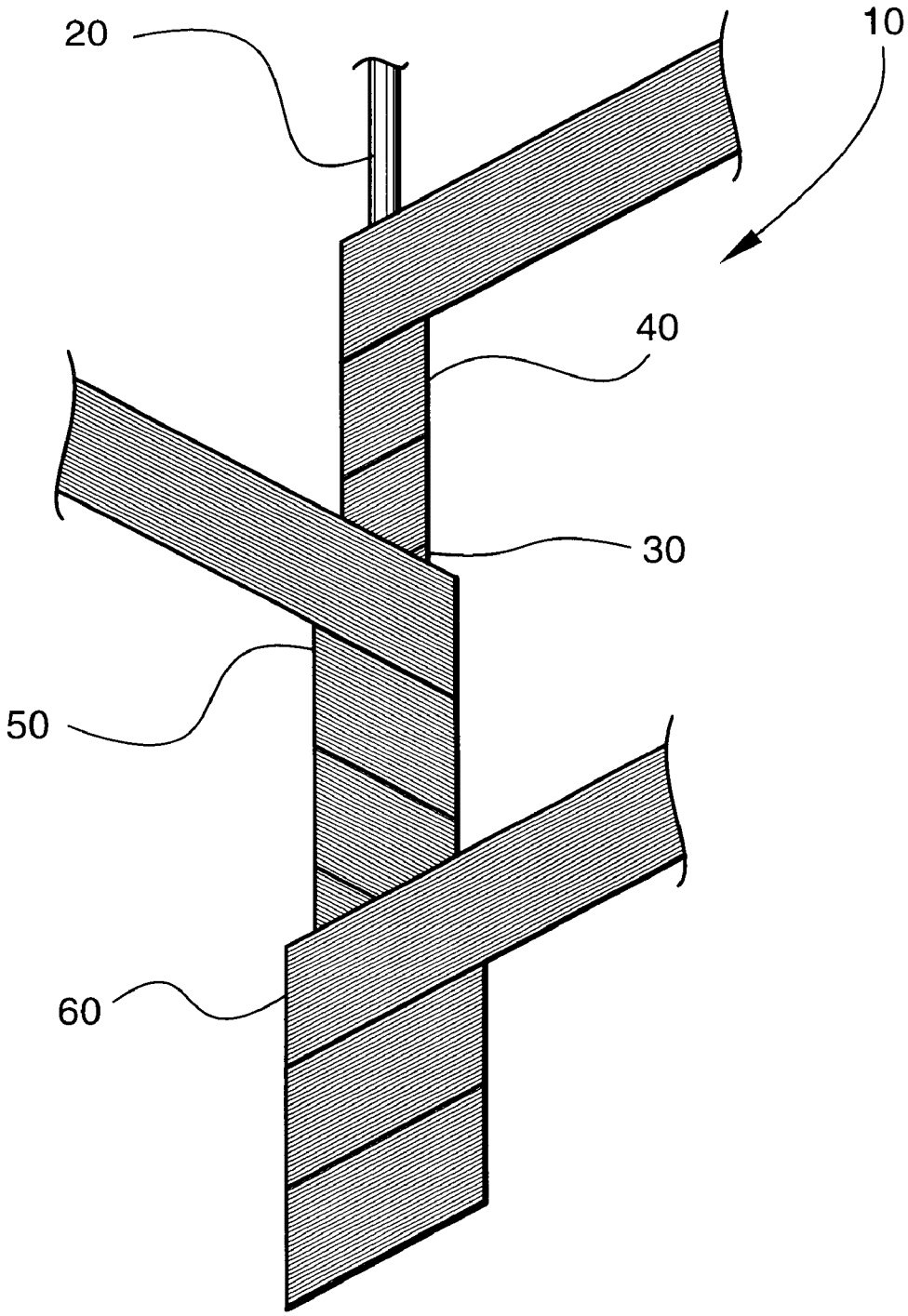
FIG. 1 is a front view of a partially unwound protective yarn of the present invention.

FIG. 1 shows a preferred embodiment of the invented protective yarn, referred to generally as 10. The protective yarn 10 is a composite which includes a core 20 and at least one cover member, referred to generally as 30. The cover members 30 minimize break out of fiberglass fragments from the core strand 20. In order to include knittability and minimize fiberglass core fragment breakout, the cover members 30 are wrapped, wound or twisted in a direction opposite that of an adjacent member.

Preferably, the cover member 30 has three helical covers. An inner cover 40 is wrapped, wound or twisted on the core 20. A middle cover 50 is wrapped, wound or twisted on the inner core 40 such that the orientation of the middle cover helix is opposite that of the inner cover helix. An outer cover 60 is wrapped, wound or twisted on the middle cover 50 such that the orientation of the outer cover helix is opposite that of the middle cover helix.

In FIG. 1, the inner cover 40 is wrapped on the core 20 in a right hand direction. The middle cover 50 is wrapped on the inner cover 40 in a left hand direction. The outer cover 60 is wrapped on the middle cover 50 in a right hand direction.

The core 20 is preferably a single longitudinal strand of fiberglass fiber. The fiber must have be substantially hard and sufficiently flexible to permit the protective yarn to be knitted into a protective fabric or garment on conventional knitting or weaving machines. A G-50 glass fiber having an 890 denier is exemplary. Naturally, a fiberglass strand having about the same denier count may be substituted for the G-50 glass fiber 20 shown in FIG. 1.

While the core 20 is a glass fiber, the cover members 30 will have at least one layer of a fiber which will provide cut protection. Furthermore, at least one of the cover members 30 will be a fiber selected from the group consisting of aramid fiber, ultrahigh molecular weight polyolefin fiber, polyester, nylon and polyacrylic fibers.

In the embodiment seen in FIG. 1, inner cover 40 is 650 denier Spectra®, an extended chain polyethylene or polyolefin. The middle cover 50 is a 650 Spectra® fiber. As seen in FIG. 1, the outer cover is a Type 1000 650 denier Spectra® from AlliedSignal Inc. as opposed to Type 900 650 denier AlliedSignal Spectra®. Of course, outer cover 60 may also employ Type 900 AlliedSignal Spectra® or a substantially equivalent denier. The composite denier of protective yarn 10 is 3190.

The number of turns per inch that the cover members 30 are wound around the core 20 varies according to the cover layer and cover material. In FIG. 1, the inner cover 40 is wound on the core 20 at approximately 4.8 turns per inch. The middle cover 50 is wound on the inner cover 40 at approximately 9.1 turns per inch. The outer cover 60 is wrapped on the middle cover 50 at approximately 8.2 turns per inch.

The triple winding of the cover members 30 in opposite directions on the fiberglass core 20 minimizes glass fragment breakout and therefore reduces the amount of irritation from the glass fragments to the hands of a wearer.

Figure 2:
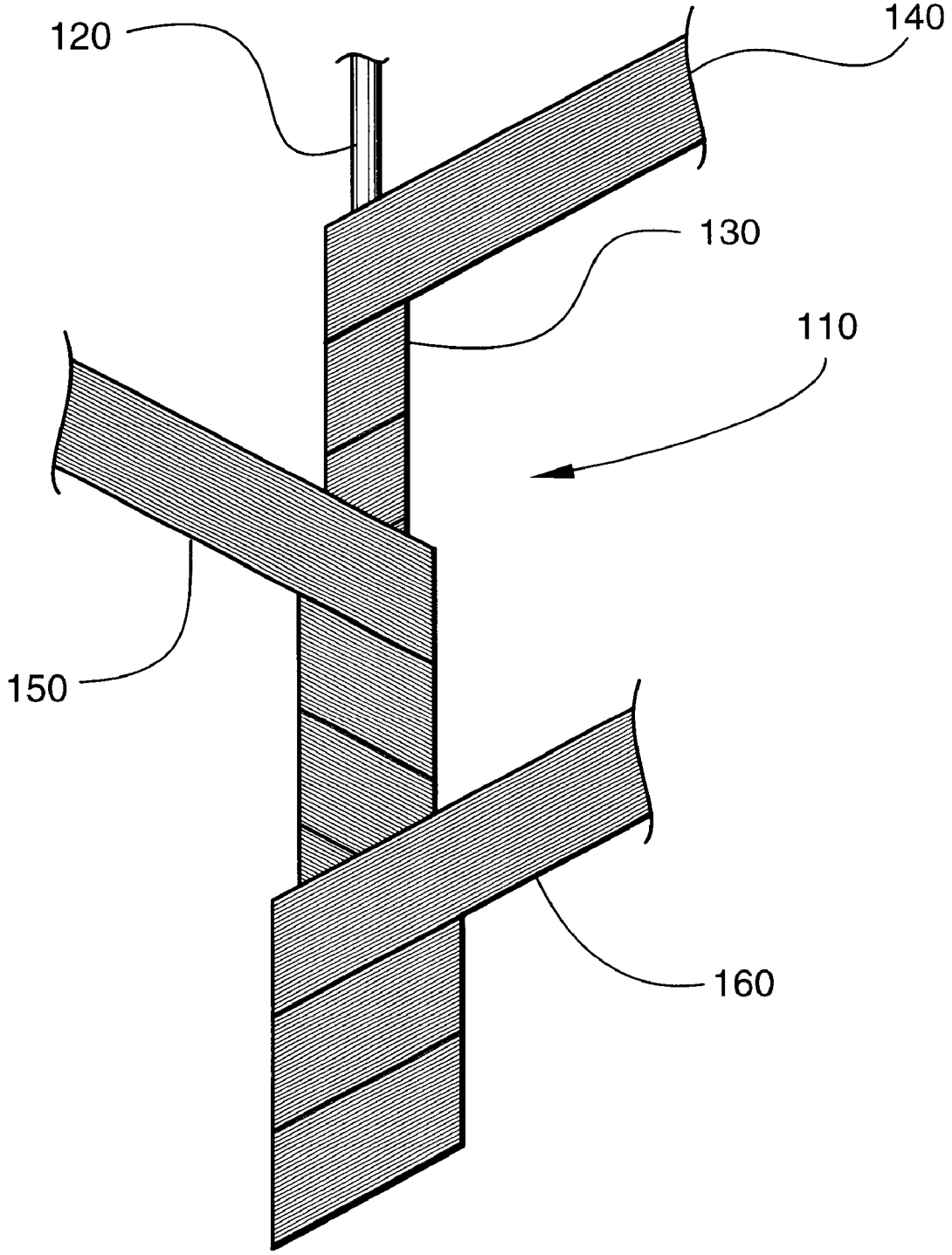
FIG. 2 is a front view of a partially unwound alternative embodiment of the protective yarn of the present invention.

A second embodiment of the present invention is shown in FIG. 2. A protective yarn, generally referred to as 110, has a single longitudinal strand of fiberglass as the yarn core 120. Cover members, generally referred to as 130, are wound on the core 120.

In this embodiment of the present invention, one of the cover members 30 is a substantially non-slippery fiber. The non-slippery fiber is selected from the group consisting of polyester, nylon and cotton. As shown in FIG. 2, the outer cover 60 is a 1000 denier Polyester.

In FIG. 2, the yarn core 120 is a G-50 glass strand of 890 denier. The cover members 130 has three helical covers. An inner cover 140 is wrapped on the core 120. A middle cover 150 is wrapped on the inner core 140 such that the orientation of the middle cover helix is opposite that of the inner cover helix. An outer cover 160 is wrapped on the middle cover 150 such that the orientation of the outer cover helix is opposite that of the middle cover helix.

In FIG. 2, the inner cover 140 is wrapped on the core 120 in a right hand direction. The middle cover 150 is wrapped on the inner cover 140 in a left hand direction. The outer cover 160 is wrapped on the middle cover 150 in a right hand direction.

FIG. 2 shows an inner cover 140 using 650 denier AlliedSignal Spectra® Type 900. The inner cover 140 is wound around the core 120 at 4.8 turns per inch. The middle cover 150 uses 650 denier AlliedSignal Spectra® Type 900. The middle cover 150 is wound on the inner cover 140 at 9.1 turns per inch. The outer cover 160 is 1000 denier polyester. The outer cover 160 is wound on the middle cover 150 at 8.2 turns per inch. The composite denier of protective yarn 110 is 3780.

The triple winding of the cover members 130 in opposite directions on the fiberglass core 120 minimizes glass fragment breakout and therefore reduces the amount of irritation from the glass fragments to the hands of a wearer.

It should be noted that outer cover 160 could be polyester, nylon, cotton or a similar non-high cut-resistant fiber. The use of a non-high cut-resistant fiber as an outer cover 160 reduces the "slickness" of any glove or other fabric knitted from protective yarn 110. Because it is known that Spectra® is "slick" therefore making it more difficult for a user to grasp an item without slippage while wearing a glove formed from a protective yarn 110 in which outer covers 160 are Spectra®, the outer cover 160 is so formulated.

An additional benefit of the present invention's yarn structure and yarn components is that the shrinkage of any fabric made from such yarn is reduced from that of a yarn having a Spectra® member(s) in the core 120. Because Spectra® shrinks along its longitudinal axis from exposure to extreme heat typical in the cleaning process, the garment or item composed soley of such fibers will tend to shrink or disform thereby rendering the garment useless. The fiberglass core in the present invention, however, does not suffer from this problem. Furthermore, when the Spectra® cover member shrink around the fiberglass core, the cover members will merely wrap somewhat more tightly around the core 120.

Table 1 reflects the reduction in shrinkage between gloves containing fiberglass as in the present invention and gloves containing only Spectra® fibers as in the prior art.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

We claim:

1. A composite yarn comprising:

a) a core consisting of a fiberglass strand having a denier of about 890;

b) a non-metallic sheath strand having a denier of 650, the sheath strand being wrapped around the core; and c) at least one cover strand wrapped around the sheath strand at the rate of about 9.1 turns per inch, whereby the sheath strand permits the fiberglass strand to be knitted using conventional knitting equipment.

2. The composite yarn of claim 1 wherein said sheath strand is wrapped around the core at a rate of about 4.8 turns per inch.

3. The composite yarn of claim 1 wherein said sheath strand is formed of fibers or filaments selected from the group consisting of extended chain polyethylene, aramid nylon, and polyester.

4. The composite yarn of claim 1 further comprising a second non-metallic cover strand wrapped on said yarn, said second cover strand being wrapped about said at least one cover strand in a direction opposite that of the at least one cover strand.

5. The composite yarn of claim 4, wherein said second cover strand is wrapped at a rate of about 8.2 turns per inch.

6. The composite yarn of claim 4, wherein said second cover strand has a denier of 650.

7. The composite yarn of claim 4, wherein said at least one cover strand is formed of fibers or filaments selected from the group consisting of extended chain polyethylene, aramid, nylon, and polyester.

8. The composite yarn of claim 1, further comprising a second non-metallic cover strand wrapped on said yarn, said second cover strand being wrapped about said at least one cover strand in a direction opposite that of the at least one cover strand, wherein the yarn has a composite denier of 3190 or 3780.

9. The composite yarn of claim 8, wherein said second cover strand is wrapped at a rate of about 8.2 turns per inch.

10. The composite yarn of claim 8, wherein said second cover strand has a denier of 650.

11. The composite yarn of claim 8, wherein said at least one cover strand is formed of fibers or filaments selected from the group consisting of extended chain polyethylene, aramid, nylon, and polyester.

12. A flexible, composite, cut and abrasion resistant yarn comprising:

a) a non-nmetalic composite core consisting of a single fiberglass strand;

b) a sheath strand, the sheath strand being wrapped around the core whereby the sheath strand permits the core to be knitted using conventional knitting equipment; and c) a non-metallic covering wrapped on said core and said sheath strand, said covering including:

i) a bottom cover strand wrapped about the sheath strand in a first direction;

ii) a top cover strand wrapped about said bottom cover strand in a second direction opposite to the first direction.

13. The composite yarn of claim 12, wherein said sheath strand is formed of fibers or filaments selected from the group consisting of extended chain polyethylene, aramid, nylon, and polyester.

14. The composite yarn of claim 12, wherein said bottom cover strand is formed of fibers or filaments selected from the group consisting of extended chain polyethylene, aramid, nylon, and polyester.

15. The composite yarn of claim 12, wherein said top cover strand is formed of fibers or filaments selected from the group consisting of extended chain polyethylene, aramid, nylon, and polyester.

16. The composite yarn of claim 12, wherein said bottom cover strand is wrapped about said core at a rate of about 9.1 turns per inch.

17. The composite yarn of claim 12, wherein said top cover strand is wrapped about said core and said bottom cover strand at a rate of about 8.2 turns per inch.

18. The composite yarn of claim 12, wherein said bottom cover strand has a denier of about 650.

19. A flexible, composite, cut and abrasion resistant yarn comprising:

a) a non-metallic composite core consisting of a single fiberglass strand having a denier of about 890;

b) a sheath strand, the sheath strand being wrapped around the core whereby the sheath strand permits the core to be knitted using conventional knitting equipment; and c) a non-metallic covering wrapped on said core and said sheath strand, said covering including:

i) a bottom cover strand wrapped about the sheath strand in a first direction, the bottom cover strand having a denier of 650;

ii) a top cover strand wrapped about said bottom cover strand in a second direction opposite to the first direction, the top cover strand having a denier of about 650, wherein the yarn has a composite denier of 3190 or 3780.

20. The composite yarn of claim 19, wherein said sheath strand is formed of fibers or filaments selected from the group consisting of extended chain polyethylene, aramid, nylon, and polyester.

21. The composite yarn of claim 19, wherein said bottom cover strand is formed of fibers or filaments selected from the group consisting of extended chain polyethylene, aramid, nylon, and polyester.

22. The composite yarn of claim 19, wherein said top cover strand is formed of fibers or filaments selected from the group consisting of extended chain polyethylene, aramid, nylon, and polyester.

23. The composite yarn of claim 19, wherein said bottom cover strand is wrapped about said core at a rate of about 9.1 turns per inch.

24. The composition yarn of claim 19, wherein said top cover strand is wrapped about said core and said bottom cover strand at a rate of about 8.2 turns per inch.

25. A flexible, cut and abrasion resistant composite yarn comprising:

a) a non-metallic composite core consisting of a single fiberglass strand;

b) a sheath strand, said strand formed of extended chain polyethylene and being wrapped around the core, whereby the sheath strand permits the core to be knitted using conventional knitting equipment; and c) a non-metallic covering wrapped on said core and said sheath strand, said covering including:

i) a bottom cover strand formed of extended chain polyethylene wrapped about said sheath strand in a direction opposite that of the sheath strand, the bottom cover strand having a denier of about 650; and ii) a top cover strand formed of polyester and wrapped about said bottom cover strand in a direction opposite that of the bottom cover strand.

26. The composite yarn of claim 25, wherein said sheath strand is wrapped around said fiberglass strand at a rate of about 4.8 turns per inch.

27. A flexible, cut and abrasion resistant composite yarn comprising:

a) a non-metallic composite core consisting of a single fiberglass strand having a denier of about 890;

b) a sheath strand, said strand formed of extended chain polyethylene and having a denier of 650, the sheath strand being wrapped around the core whereby the sheath strand permits the core to be knitted using conventional knitting equipment; and c) a non-metallic covering wrapped on said core and said sheath strand, said covering including:

i) a bottom cover strand formed of extended chain polyethylene wrapped about said sheath strand in a direction opposite that of the sheath strand, the bottom cover strand having a denier of 650; and ii) a top cover strand formed of polyester and wrapped about said bottom cover strand in a direction opposite that of the bottonm cover strand, the top cover strand having a denier of 1000, wherein the yarn has a composite denier of 3780.

28. The composite yarn of claim 27, wherein said sheath strand is wrapped around said core at a rate of about 4.8 turns per inch.

29. The composite yarn of claim 28, wherein said inner cover is formed of fibers or filaments selected from the group consisting of extended chain polyethylene, aramid, nylon, and polyester.

30. The composite yarn of claim 28, further comprising an outer cover wrapped on said yarn, said outer cover being wrapped about said middle cover in a direction opposite that of the middle cover.

31. The composite yarn of claim 30, wherein said outer cover is wrapped at a rate of about 8.2 turns per inch.

32. The composite yarn of claim 30, wherein said outer cover has a denier of 650.

33. The composite yarn of claim 30, wherein said middle cover is formed of fibers or filaments selected from the group consisting of extended chain polyethylene, aramid, nylon, and polyester.

34. A composite yarn comprising:

a) a core consisting of a fiberglass strand having a denier of about 890;

b) a non-metallic inner cover having a denier of 650, the inner cover being wrapped around the core; and c) a middle cover wrapped around the inner cover at the rate of about 9.1 turns per inch, whereby the inner cover permits the core to be knitted using conventional knitting equipment.

35. The composite yarn of claim 34, wherein said inner cover is wrapped at a rate of about 4.8 turns per inch.

36. The composite yarn of claim 34, wherein said inner cover is formed of fibers or filaments selected from the group consisting of extended chain polyethylene, aramid, nylon, and polyester.

37. Thee composite yarn of claim 34, further comprising another cover wrapped on said yarn, said outer cover being wrapped about said middle cover in a direction opposite that of the middle cover.

38. The composite yarn of claim 37, wherein said outer cover is wrapped at a rate of about 8.2 turns per inch.

39. The composite yarn of claim 37, wherein said outer cover has a denier of 650.

40. The composite yarn of claim 37, wherein said middle cover is formed of fibers or filaments selected from the group consisting of extended chain polyethylene, aramid, nylon, and polyester.

41. The composite yarn of claim 34, further comprising an outer cover wrapped on said yarn, said outer cover being wrapped about said middle cover in a direction opposite that of the middle cover, wherein the yarn has a composite denier of 3190 or 3780.

42. The composite yarn of claim 41, wherein said outer cover is wrapped at a rate of about 8.2 turns per inch.

43. The composite yarn of claim 41, wherein said outer cover has a denier of 650.

44. The composite yarn of claim 41, wherein said middle cover is formed of fiber or filaments selected from the group consisting of extended chain polyethylene, aramid, nylon, and polyester.

45. A flexible, composite, cut and abrasion resistant yarn comprising:

a) a non-metallic composite core consisting of a single fiberglass strand having a denier of about 890;

b) an inner cover, the inner cover being wrapped around the core whereby the inner cover permits the core to be knitted using conventional knitting equipment; and c) a non-metallic covering wrapped on said core, said covering including:

i) a middle cover wrapped about the inner cover in a first direction, the middle cover having a denier of 650;

ii) an outer cover wrapped about said middle cover in a second direction opposite to the first direction, the outer cover having a denier of about 650, wherein the yarn has a composite denier of 3190 or 3780.

46. The composite yarn of claim 45, wherein said ininer cover is formed of fibers or filaments selected from the group consisting of extended chain polyethylene, aramid, nylon, and polyester.

47. The composite yarn of claim 45, wherein said middle cover is formed of fibers or filaments selected from the group consisting of extended chain polyethylene, aramid, nylon, and polyester.

48. The composite yarn of claim 45, wherein said outer cover is formed of fibers or filaments selected from the group consisting of extended chain polyethylene, aramid, nylon, and polyester.

49. The composite yarn of claim 45, wherein said middle cover is wrapped about said inner cover at a rate of about 9.1 turns per inch.

50. The composite yarn of claim 45, wherein said outer cover is wrapped about said middle cover at a rate of about 8.2 turns per inch.

51. A flexible, cut and abrasion resistant composite yarn comprising:

a) a non-metallic composite core consisting of a single fiberglass strand;

b) an inner cover formed of extended chain polyethylene, whereby the inner cover permits the core to be knitted using conventional knitting equipment; and c) a non-metallic covering wrapped on said inner cover, said covering including:

i) a middle cover formed of extended chain polyethylene wrapped about said inner cover in a direction opposite that of the inner cover, the middle cover having a denier of about 650; and ii) a outer cover formed of polyester and wrapped about said middle cover in a direction opposite that of the middle cover.

52. The composite yarn of claim 51, wherein said inner cover is wrapped around said core at a rate of about 4.8 turns per inch.

53. A flexible, cut and abrasion resistant composite yarn comprising:

a) a non-metallic composite core consisting of a single flberglass strand having a denier of about 890;

b) an inner cover formed of extended chain polyethylene and having a denier of 650, the inner cover being wrapped around the core whereby the inner cover permits the core to be knitted using conventional knitting equipment; and c) a non-metallic covering wrapped on said inner cover, said covering including:

i) a middle cover formed of extended chain polyethylene wrapped about said inner cover in a direction opposite that of the inner cover, the middle cover having a denier of 650; and ii) a outer cover formed of polyester and wrapped about said middle cover in a direction opposite that of the middle cover, the outer cover having a denier of 1000, wherein the yarn has a composite denier of 3780.

54. The composite yarn of claim 53, wherein said inner cover is wrapped around said core at a rate of about 4.8 turns per inch.

55. A flexible, composite, cut and abrasion resistant yarn comprising:

a) a non-metallic composite core consisting of a single fiberglass strand;

b) an inner cover, the inner cover being wrapped around the core whereby the inner cover permits the core to be knitted using conventional knitting equipment;

c) a middle cover wrapped about the inner cover in a first direction; and d) an outer cover wrapped about said middle cover in a second direction opposite to the first direction.

56. The composite yarn of claim 55, wherein said inner cover is formed of fibers or filaments selected from the group consisting of extended chain polyethylene, aramid, nylon, and polyester.

57. The composite yarn of claim 55, wherein said middle cover is formed of fibers or filaments selected from the group consisting of extended chain polyethylene, aramid, nylon, and polyester.

58. The composite yarn of claim 55, wherein said outer cover is formed of fibers or filaments selected from the group consisting of extended chain polyethylene, aramid, nylon, and polyester.

59. The composite yarn of claim 55, wherein said middle cover is wrapped about said inner cover at a rate of about 9.1 turns per inch.

60. The composite yarn of claim 55, wherein said outer cover is wrapped about said middle cover at a rate of about 8.2 turns per inch.

61. The composite yarn of claim 55, wherein said middle cover has a denier of about 650.

62. A flexible, composite, cut and abrasion resistant yarn comprising:

a) a non-metallic composite core consisting of a single fiberglass strand having a denier of about 890;

b) an inner cover, the inner cover being wrapped around the core whereby the inner cover permits the core to be knitted using conventional knitting equipment; and c) a middle cover wrapped about the inner cover in a first direction, the middle cover having a denier of 650;

d) an outer cover wrapped about said middle cover in a second direction opposite to the first direction, the outer cover having a denier of about 650, wherein the yarn has a composite denier of 3190 or 3780.

63. The composite yarn of claim 62, wherein said inner cover is formed of fibers or filaments selected from the group consisting of extended chain polyethylene, aramid, nylon, and polyester.

64. The composite yarn of claim 62, wherein said middle cover is formed of fibers or filaments selected from the group consisting of extended chain polyethylene, aramid, nylon, and polyester.

65. The composite yarnla of claim 62, wherein said outer cover is formed of fibers or filaments selected from the group consisting of extended chain polyethylene, aramid, nylon, and polyester.

66. The composite yarn of claim 62, wherein said middle cover is wrapped about said inner cover at a rate of about 9.1 turns per inch.

67. The composite yarn of claim 62, wherein said outer cover is wrapped about said middle cover at a rate of about 8.2 turns per inch.

68. A flexible, cut and abrasion resistant composite yarn comprising:

a) a non-metallic composite core consisting of a single fiberglass strand;

b) an inner cover formed of extended chain polyethylene, whereby the inner cover permits the core to be knitted using conventional knitting equipment; and c) a middle cover formed of extended chain polyethylene wrapped about said inner cover in a direction opposite that of the inner cover, the middle cover having a denier of about 650; and d) an outer cover formed of polyester and wrapped about said middle cover in a direction opposite that of the middle cover.

69. The composite yarn of claim 68, wherein said inner cover is wrapped around said core at a rate of about 4.8 turns per inch.

70. A flexible, cut and abrasion resident composite yarn comprising:

a) a non-metallic composite core consisting of a single fiberglass strand having a denier of about 890;

b) an inner cover formed of extended chain polyethylene and having a denier of 650, the inner cover being wrapped around the core whereby the inner cover permits the core to be knitted using conventional knitting equipment; and c) a middle cover formed of extended chain polyethylene wrapped about said inner cover in a direction opposite that of the inner cover, the middle cover having a denier of 650; and d) an outer cover formed of polyester and wrapped about said middle cover in a direction opposite that of the middle cover the outer cover having a denier of 1000, wherein the yarn has a composite denier of 3780.

71. The composite yarn of claim 70, wherein said inner cover is wrapped around said core at a rate of about 4.8 turns per inch.

* * * * *

UNITED STATES PATENT AND TRADEMARK OFFICE

CERTIFICATE OF CORRECTION

PATENT NO. : 6,413,636 B1 
DATED : July 2, 2002
INVENTOR(S) : Mark A. Andrews and Gregory V. Andrews It is certified that error appears in the above-identified patent and that said Letters Patent is hereby corrected as shown below:

Column 2,
Line 7, delete "Spectrao" and insert -- Spectra®" --

Column 4,
Line 42, after "resistance" insert -- equal to or greater than that obtained by using purely engineered --
Line 61, delete "Spectram" and insert -- Spectra® --

Column 5,
Lines 28-29, delete "Spec-traO" and insert -- Spectra® --

Column 8,
Line 37, delete "non-nmetalic" and insert -- non-metallic --

Column 10,
Line 44, delete "Thee" and insert -- The --.
Line 45, delete "another" and insert -- an outer --

Column 11,
Line 17, delete "ininer" and insert -- inner --.

Column 12,
Line 63, delete "yarnla" and insert -- yarn --

UNITED STATES PATENT AND TRADEMARK OFFICE

CERTIFICATE OF CORRECTION

PATENT NO. : 6,413,636 B1 
DATED : July 2, 2002
INVENTOR(S) : Mark A. Andrews and Gregory V. Andrews It is certified that error appears in the above-identified patent and that said Letters Patent is hereby corrected as shown below:

Column 14,
Line 1, delete "resident" and insert -- resistant --
Line 15, insert "," after the word "cover" - second word in line Signed and Sealed this Third Day of December, 2002

JAMES E. ROGAN
*Director of the United States Patent and Trademark Office*